US012703963B2

(12) United States Patent
Ruvang

(10) Patent No.: US 12,703,963 B2
(45) Date of Patent: Aug. 11, 2026

(54) MATERIAL HANDLING IMPLEMENT WITH WEAR COMPONENT SECUREMENT

(71) Applicant: BLACK CAT WEAR PARTS, LTD., Edmonton (CA)

(72) Inventor: John A. Ruvang, Bartonville, TX (US)

(73) Assignee: BLACK CAT WEAR PARTS, LTD., Edmonton (CA)

( * ) Notice: Subject to any disclaimer, the term of this patent is extended or adjusted under 35 U.S.C. 154(b) by 910 days.

(21) Appl. No.: 17/847,536

(22) Filed: Jun. 23, 2022

(65) Prior Publication Data

US 2023/0417028 A1 Dec. 28, 2023

(51) Int. Cl.
*E02F 9/28* (2006.01)

(52) U.S. Cl.
CPC ..... *E02F 9/2833* (2013.01); *E02F 9/2825* (2013.01); *E02F 9/2883* (2013.01)

(58) Field of Classification Search
CPC ..... E02F 9/28; E02F 9/2816; E02F 9/2833; E02F 9/2825; E02F 9/2841
See application file for complete search history.

(56) References Cited

U.S. PATENT DOCUMENTS 4,433,496 A * 2/1984 Jones ..... E02F 9/2833 37/456
4,663,867 A * 5/1987 Hahn ..... E02F 9/2841 37/459
5,410,826 A * 5/1995 Immel ..... E02F 9/2833 37/457
5,412,885 A 5/1995 Cornelius
5,465,512 A 11/1995 Livesay et al.
5,784,813 A * 7/1998 Balassa ..... E02F 9/2825 37/457
5,964,547 A * 10/1999 Brinkley ..... E02F 9/2833 37/456
6,009,644 A * 1/2000 Hedley ..... E02F 9/2833 37/456
6,108,950 A * 8/2000 Ruvang ..... E02F 9/2825 37/456

(Continued)

OTHER PUBLICATIONS

Chilean Examination Report issued Feb. 13, 2026 for CL Patent Application No. 202403549, 13 pages.

(Continued)

*Primary Examiner* — Christopher J Sebesta
*Assistant Examiner* — Audrey L Lusk
(74) *Attorney, Agent, or Firm* — Smith IP Services, P.C.

(57) ABSTRACT

A fastening system can include a clamp configured to engage profiles formed in respective legs of a wear component, a wedge having a face configured to engage the clamp, and another face being configured to engage a surface of an opening formed through a lip, an externally threaded member rotatable by a shaft, and a biasing device that exerts an axially biasing force against the threaded member. A method can include positioning a wear component on a lip, installing a clamp into an opening formed through the lip, engaging surfaces of the clamp with profiles formed in legs of a wear component, installing a wedge into the opening, a face of the wedge engaging the clamp and an opposing face of the wedge engaging a surface of the opening, and rotating a shaft, thereby compressing a biasing device and exerting a biasing force that biases the wedge into the opening.

18 Claims, 3 Drawing Sheets

(56) References Cited

U.S. PATENT DOCUMENTS

| | | | | |
|---|---|---|---|---|
| 6,301,810 | B1 * | 10/2001 | Fidler | E02F 9/2825 37/458 |
| 6,986,216 | B2 | 1/2006 | Emrich et al. | |
| 7,299,570 | B2 | 11/2007 | Emrich et al. | |
| 7,516,564 | B2 * | 4/2009 | Ruvang | E02F 9/2833 37/456 |
| 8,302,333 | B2 * | 11/2012 | Ruvang | E02F 9/2825 37/455 |
| 9,409,258 | B2 | 8/2016 | Ruvang | |
| 9,518,380 | B2 * | 12/2016 | Campomanes | E02F 9/2841 |
| 9,657,463 | B2 | 5/2017 | Ruvang | |
| 2004/0107608 | A1 * | 6/2004 | Meyers | E02F 9/2883 37/452 |

OTHER PUBLICATIONS

English Translation of Chilean Examination Report issued Feb. 13, 2026 for CL Patent Application No. 202403549, 13 pages.

* cited by examiner

MATERIAL HANDLING IMPLEMENT WITH WEAR COMPONENT SECUREMENT

BACKGROUND

This disclosure relates generally to mining, excavation and material handling equipment and, in an example described below, more particularly provides for securement of a wear component on an implement.

The forward edge of material handling implements, such as buckets and shovels, etc., is subject to impacts, abrasion and other types of wear and damage. Expendable wear components, such as teeth, shrouds and adapters, can be used to protect a forward edge of a material handling implement. A fastening system used to releasably attach a wear component to an implement should be constructed so that it can reliably withstand the impacts to which it is subjected, as well as wear between the forward edge and the wear component.

It will, therefore, be appreciated that improvements are continually needed in the art of securing wear components on material handling implements. Such improvements are provided to the art by the present disclosure, and these improvements can be realized in a wide variety of different configurations.

DETAILED DESCRIPTION

Figure 1:
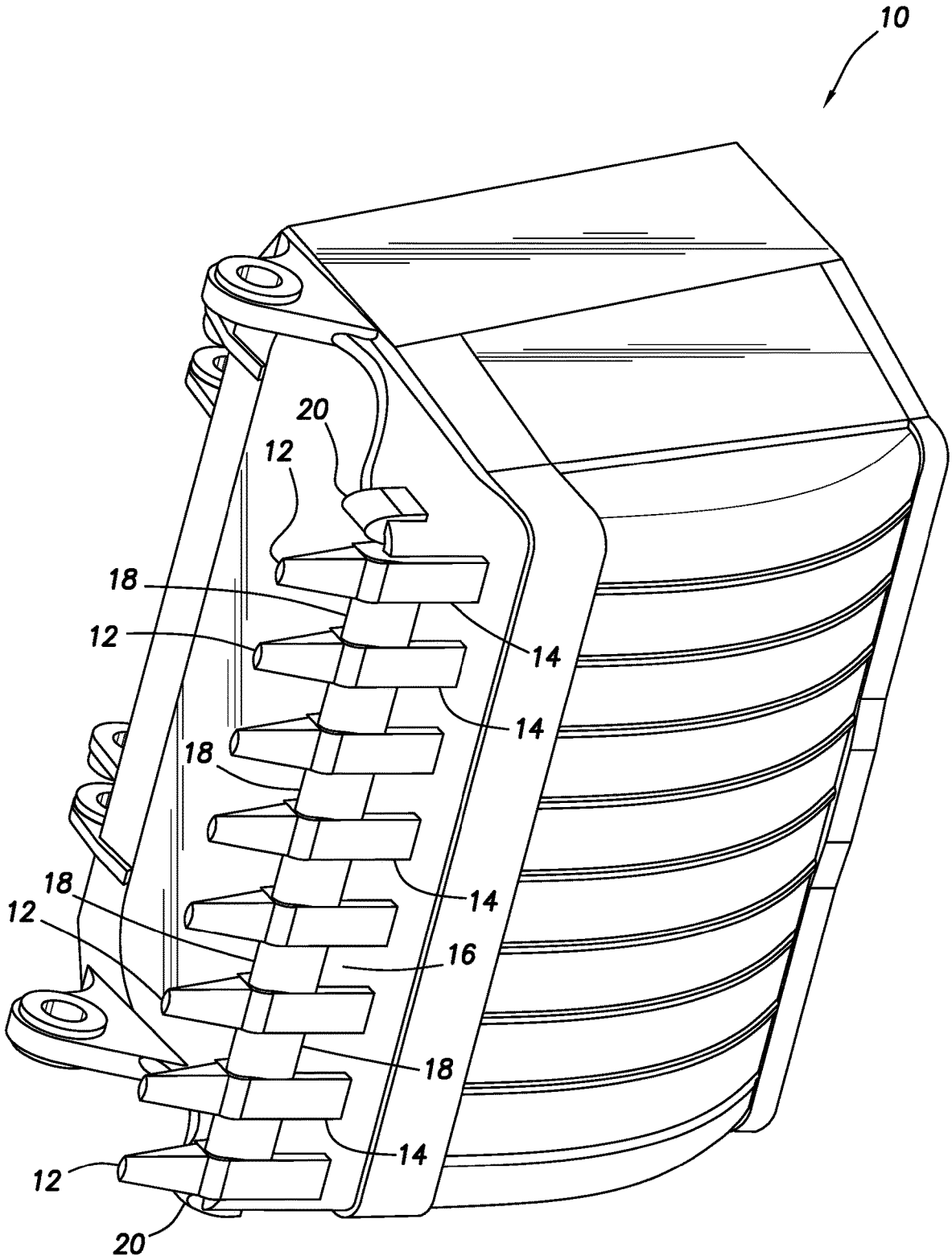
FIG. 1 is a representative partially cross-sectional view of an example of a material handling implement which can embody principles of this disclosure.

Representatively illustrated in FIG. 1 is an implement 10 for a material handling apparatus which can embody principles of this disclosure. However, it should be clearly understood that the implement 10 is merely one example of an application of the principles of this disclosure in practice, and a wide variety of other examples are possible. Therefore, the scope of this disclosure is not limited at all to the details of the implement 10 described herein and/or depicted in the drawings.

In the example of FIG. 1, the implement 10 is of the type known as a "dipper" or "bucket" of a cable shovel, but it should be clearly understood that the principles of this disclosure can be utilized with other types of mining, excavation (or other material handling) implements. In the illustration of FIG. 1, the implement 10 is rotated so that a bottom material-engaging side of the implement is clearly visible. From this perspective, it may be seen that multiple teeth 12 are mounted on the implement 10 for piercing the earth or other material.

The teeth 12 are typically rapidly worn down or otherwise damaged during use of the implement 10, and so the teeth are replaced periodically or when excessive wear is evident. Specially configured adapters 14 releasably secure the teeth 12 to a forward edge of a lip 16 of the implement 10 in this example. In other examples, the teeth 12 may be secured directly to the lip 16.

The teeth 12 and adapter 14 are merely examples of wear components that can be securely and conveniently attached to a material handling implement using the principles of this disclosure. Other examples of wear components include shrouds 18, 20 which protect forward material-engaging edges of the lip 16 and sides of the implement 10. Thus, the scope of this disclosure is not limited to use of any particular types of wear components.

As used herein, the term "forward" is used to indicate a direction in which the implement 10 displaces to engage a material. Thus, a forward edge of the lip 16 would first engage the material, if the forward edge were not protected by the teeth 12, adapter 14 and shrouds 18, 20. The term "rearward" is used to indicate an opposite direction. Thus, in the FIG. 1 example, a rearward direction would be toward a back of the implement 10 from the forward edge of the lip 16.

Figure 2:
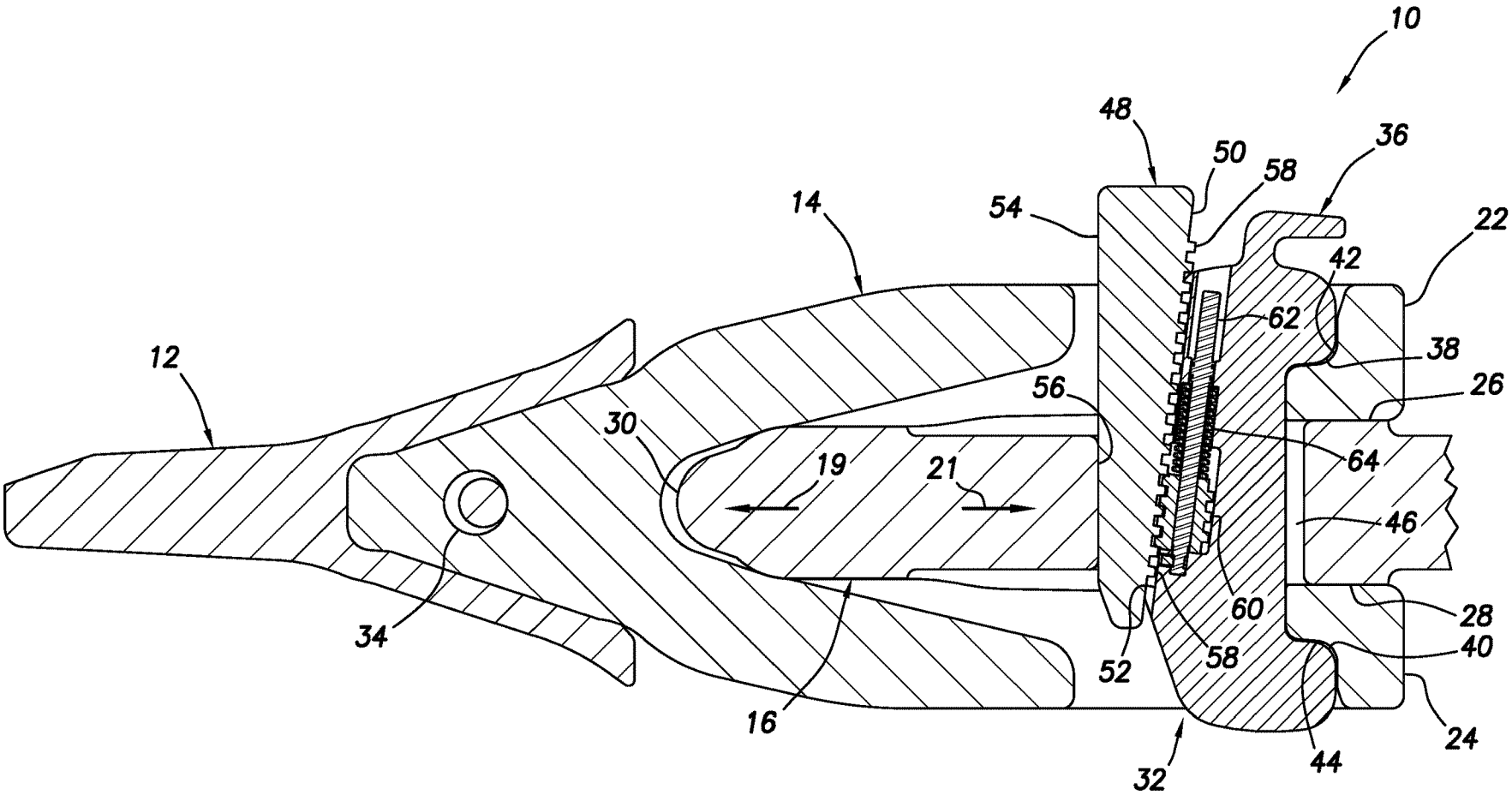
FIG. 2 is a representative cross-sectional view of an example of a wear component positioned on the material handling implement.

Referring additionally now to FIG. 2, a cross-sectional view of an example of the tooth 12 and adapter 14 mounted on the lip 16 of the material handling implement 10 is representatively illustrated. The tooth 12, adapter 14 and lip 16 may be used with the FIG. 1 implement 10, or they may be used with other implements, whether for mining, excavation or other material handling purposes. The scope of this disclosure is not limited to use of any particular type of implement.

As depicted in FIG. 2, the forward direction is indicated by an arrow 19. The rearward direction is indicated by another arrow 21.

In the FIG. 2 example, the adapter 14 includes an upper "leg" 22 overlying an upper surface 26 of the lip 16, and a lower "leg" 24 overlying a lower surface 28 of the lip, so that the adapter effectively wraps around a forward edge 30 of the lip.

A fastening system 32 releasably secures the adapter 14 in position on the lip 16. In this example, the fastening system 32 is similar in some respects to a conventional "Whisler-type" fastening system, but includes unique features that provide for improved securement of the adapter 14 (or other wear component) to the lip 16.

The tooth 12 is releasably secured to the adapter 14 by another fastening system 34. In other examples, the tooth 12 could be integrally formed with the adapter 14, instead of being separately attached to the adapter. Thus, the scope of this disclosure is not limited to use of any particular type of wear component on the lip 16 of the implement 10.

As depicted in FIG. 2, the fastening system 32 includes a clamp 36 configured to engage the legs 22, 24 of the adapter 14. The clamp 36 has opposing inwardly facing surfaces 38, 40 formed thereon which engage respective profiles 42, 44 formed in the adapter legs 22, 24. In the FIG. 2 example, the surfaces 38, 40 and profiles 42, 44 are in the form of complementarily shaped shoulders, but in other examples they could comprise inclined or curved surfaces, or could have other shapes.

The clamp 36 is received in an opening 46 formed through the lip 16. In this example, the clamp 36 can be installed into the opening 46 and engaged with the profiles 42, 44 in the adapter 14 after the adapter has been positioned on the lip 16.

The fastening system 32 also includes a wedge 48 installed in the opening 46. The wedge 48 has a face 50 that slidingly engages a forwardly facing surface 52 of the clamp 36, and an opposing face 54 that engages a rearwardly facing surface 56 of the opening 46. The faces 50, 54 and surfaces 52, 56 are straight and linear in this example (the face 50 and surface 52 being inclined relative to the face 54 and surface 56), but other forms of faces and surfaces may be used in other examples.

The wedge face 50 in the FIG. 2 example has a series of teeth 58 formed thereon. An externally threaded member 60 positioned partially in the clamp 36 is threadingly engaged with the teeth 58. The threaded member 60 is axially reciprocably positioned on a shaft 62 received in the clamp 36.

The threaded member 60 and the shaft 62 are configured so that they rotate together. For example, the shaft 62 could have a splined or hexagonal exterior shape that complementarily engages internal splines or a hexagonal profile formed in the threaded member 60. In these examples, the splines or hexagonal profiles can permit the threaded member 60 to displace axially along the shaft 62, but prevent relative rotation between the threaded member and the shaft. In other examples, different shapes, profiles or other means may be used to permit axial displacement of the threaded member 60 but prevent relative rotation between the threaded member and the shaft 62.

A biasing device 64 is positioned in the clamp 36 and arranged to exert a downwardly biasing force against the threaded member 60. In this example, the biasing device 64 is in the form of a coiled compression spring which surrounds the shaft 62, but in other examples an elastomeric member, a gas spring, one or more Belleville washers, or another type of biasing device may be used.

In the FIG. 2 example, the shaft 62 and threaded member 60 can be rotated by inserting a tool into a top of the clamp 36 to engage an upper end of the shaft. Depending on the direction of rotation, the threaded member 60 will either displace upwardly or downwardly relative to the clamp 36 and the wedge 48 in response to the rotation, due to the engagement between the threaded member and the teeth 58 on the face 50 of the wedge.

If the threaded member 60 is left-hand threaded, then clockwise rotation of the shaft 62 (viewed from above as depicted in FIG. 2) will cause the threaded member to displace upward along the shaft 62. This upward displacement of the threaded member 60 will compress the biasing device 64, thereby exerting an increased downwardly biasing force against the threaded member, which will be transmitted to the wedge 48 due to the engagement between the threaded member and the teeth 58.

The downwardly biasing force applied to the wedge 48 will tend to advance the wedge further into the opening 46. Due to the incline between the faces 50, 54, the downward biasing force applied to the wedge 48 will cause the face 54 to be increasingly biased against the forward surface 56 of the opening 46, and will cause the clamp surfaces 38, 40 to be increasingly biased against the profiles 42, 44 of the adapter legs 22, 24.

Thus, the adapter 14 is biased rearward relative to the lip 16 due to the compression of the biasing device 64 and the resulting downward biasing force exerted against the wedge 48. Furthermore, the adapter 14 will be continually biased rearward relative to the lip 16 due to the downward biasing force exerted against the wedge 48, even though there is wear between the adapter and the forward edge 30 of the lip.

Figure 3:
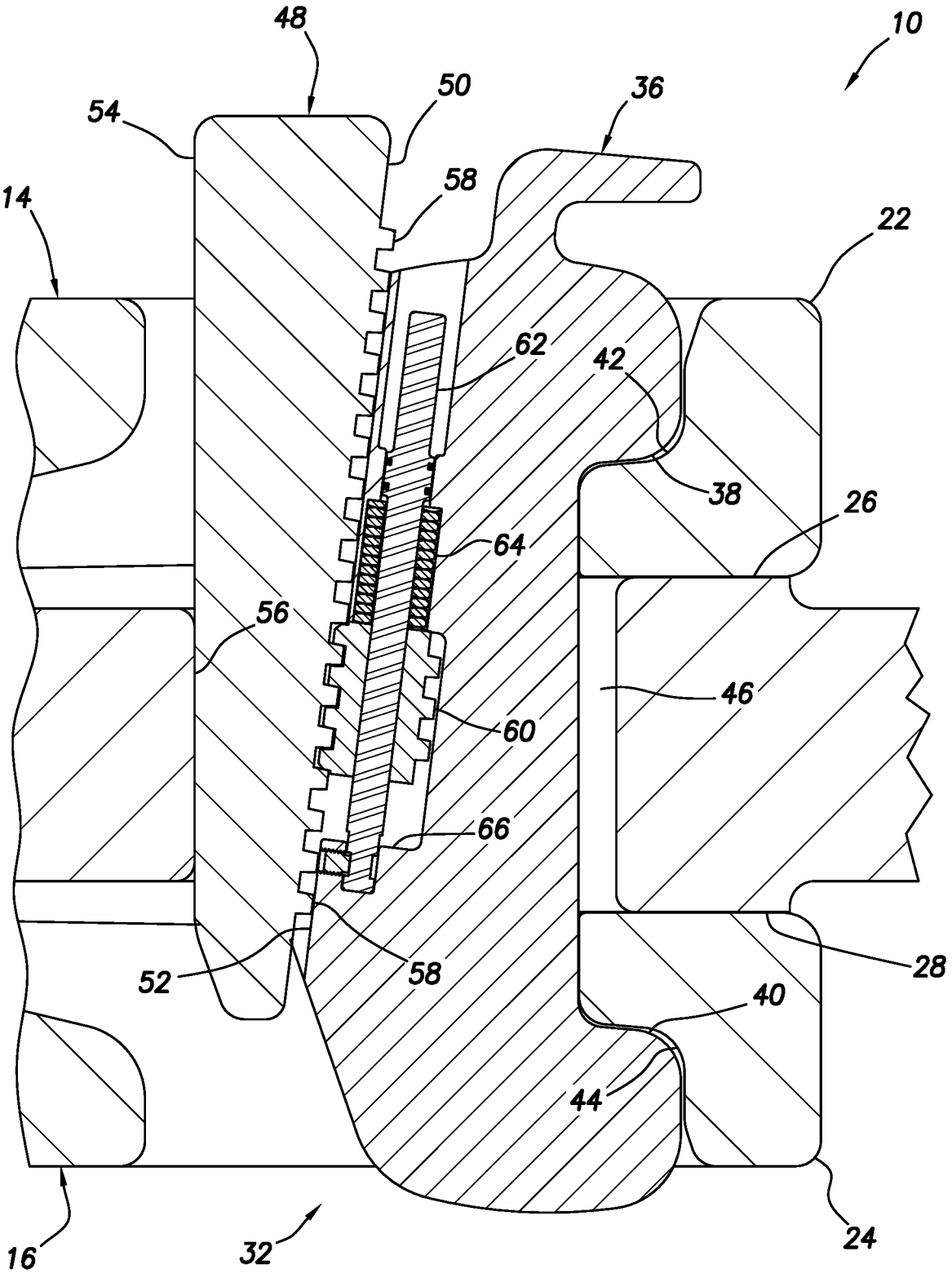
FIG. 3 is a representative cross-sectional view of an example of a fastening system securing the wear component to the material handling implement.

Referring additionally now to FIG. 3, a cross-sectional view of the fastening system 32 as used with the implement 10 is representatively illustrated. In this view, the threaded member 60 and shaft 62 have been rotated as described above, so that the biasing device 64 is axially compressed in the clamp 36.

A downwardly directed biasing force is now exerted against the threaded member 60 and the wedge 48. This biasing force biases the wedge 48 toward further insertion into the opening 46, which causes the adapter 14 to be biased rearward relative to the lip 16.

To release the adapter 14 from the lip 16, the shaft 62 can be rotated in an opposite direction, so that the threaded member 60 displaces downward on the shaft. The biasing device 64 will axially expand, thereby relieving the biasing force exerted against the threaded member 60 and the wedge 48. Further rotation of the threaded member 60 and shaft 62 after the threaded member has bottomed-out in a recess 66 in the clamp 36 may be used to displace the wedge 48 upward from the opening 46.

Although in FIGS. 2 & 3 the threaded member 60, shaft 62, biasing device 64 and recess 66 are depicted as being positioned in the clamp 36, and the teeth 58 are depicted as being formed on the face 50 of the wedge 48, it will be appreciated that in other examples the threaded member, shaft, biasing device and recess could be positioned in the wedge, and the teeth could be formed on the surface 52 of the clamp. Thus, the scope of this disclosure is not limited to any particular arrangement of elements in the fastening system 32 as depicted in the drawings or described herein.

It may now be fully appreciated that the above disclosure provides significant advancements to the art of securing a wear component on a material handling implement. In an example described above, engagement between the threaded member 60 and the teeth 58 enables a biasing force to be transmitted from the biasing device 64 to the wedge 48 to thereby bias the wedge further into the opening 46 and bias the adapter 14 rearward relative to the lip 16.

The above disclosure provides to the art a fastening system 32 for securing a wear component (such as, a tooth 12, adapter or shroud 18, 20) to a lip 16 of a material handling implement 10. In one example, the fastening system 32 can comprise a clamp 36 configured to engage profiles 42, 44 formed in respective legs 22, 24 of the wear component, a wedge 48 having opposing first and second faces 50, 54, the first face 50 being configured to engage the clamp 36, and the second face 54 being configured to engage a surface 56 of an opening 46 formed through the lip 16, a shaft 62, an externally threaded member 60 rotatable by the shaft 62, and a biasing device 64 that exerts an axially biasing force against the threaded member 60.

The threaded member 60 may be axially displaceable relative to the shaft 62. The threaded member 60 may be displaceable relative to the clamp 36 along the shaft 62.

The wedge first face 50 may comprise teeth 58 engaged with the threaded member 60. Each of the wedge first and second faces 50, 54 may be linearly extending, straight and inclined relative to each other.

Rotation of the shaft 62 may simultaneously compress the biasing device 64 and bias the wedge 48 into the lip opening 46. Compression of the biasing device 64 may cause the wedge 48 to be biased into the lip opening 46.

The above disclosure also provides to the art a method of securing a wear component (such as, a tooth 12, adapter or shroud 18, 20) to a lip 16 of a material handling implement 10. In one example, the method can comprise: positioning the wear component on the lip 16; installing a clamp 36 into an opening 46 formed through the lip 16; engaging opposing inwardly facing surfaces 38, 40 of the clamp 36 with profiles 42, 44 formed in respective legs 22, 24 of the wear component; installing a wedge 48 into the opening 46, a first face 50 of the wedge 48 engaging the clamp 36 and an opposing second face 54 of the wedge 48 engaging a surface 56 of the opening 46; and rotating a shaft 62 in the clamp 36, thereby compressing a biasing device 64 in the clamp 36 and exerting a biasing force that biases the wedge 48 into the opening 46.

The rotating step may include rotating an externally threaded member 60 that engages teeth 58 formed on the wedge first face 50. The compressing step may include displacing the threaded member 60 axially along the shaft 62.

The compressing step may include displacing the threaded member 60 relative to the clamp 36. The exerting step may include biasing the clamp 36 in a rearward direction relative to the lip 16. The exerting step and the compressing step may be performed simultaneously.

The exerting step may include biasing the wedge second face 54 against the surface 56 of the opening 46.

A fastening system 32 for securing a wear component (such as, a tooth 12, adapter or shroud 18, 20) to a lip 16 of a material handling implement 10 described above can comprise a clamp 36 having opposing inwardly facing surfaces 38, 40 configured to engage profiles 42, 44 formed in respective legs 22, 24 of the wear component 10, a wedge 48 having opposing first and second faces 50, 54, the first face 50 having a series of teeth 58 formed therein, and the second face 54 being configured to engage a surface 56 of an opening 46 formed through the lip 16, a shaft 62 positioned in the clamp 36, an externally threaded member 60 rotatable by the shaft 62, and the threaded member 60 being engaged with the wedge teeth 58, and a biasing device 64 that exerts an axially biasing force against the threaded member 60.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A fastening system for securing a wear component to a lip of a material handling implement, the fastening system comprising:

a clamp configured to engage profiles formed in respective legs of the wear component;

a wedge having opposing first and second faces, the first face being configured to engage the clamp, and the second face being configured to engage a surface of an opening formed through the lip;

a shaft;

an externally threaded member rotatable by the shaft, in which the threaded member is axially displaceable relative to the shaft; and a biasing device that exerts an axially biasing force against the threaded member.

2. The fastening system of claim 1, in which the threaded member is displaceable relative to the clamp along the shaft.

3. The fastening system of claim 1, in which the wedge first face comprises teeth engaged with the threaded member.

4. The fastening system of claim 1, in which each of the wedge first and second faces are linearly extending.

5. The fastening system of claim 1, in which rotation of the shaft simultaneously compresses the biasing device and biases the wedge into the lip opening.

6. The fastening system of claim 1, in which compression of the biasing device causes the wedge to be biased into the lip opening.

7. A method of securing a wear component to a lip of a material handling implement, the method comprising:

positioning the wear component on the lip;

installing a clamp into an opening formed through the lip;

engaging surfaces of the clamp with profiles formed in respective legs of the wear component;

installing a wedge into the opening, a first face of the wedge engaging the clamp and an opposing second face of the wedge engaging a surface of the opening; and rotating a shaft in the clamp, thereby compressing a biasing device in the clamp and exerting a biasing force that biases the wedge into the opening, in which the rotating comprises rotating an externally threaded member that engages teeth formed on the wedge first face.

8. The method of claim 7, in which the compressing comprises displacing the threaded member axially along the shaft.

9. The method of claim 7, in which the compressing comprises displacing the threaded member relative to the clamp.

10. The method of claim 7, in which the exerting comprises biasing the clamp in a rearward direction relative to the lip.

11. The method of claim 7, in which the exerting and the compressing are performed simultaneously.

12. The method of claim 7, in which the exerting comprises biasing the wedge second face against the surface of the opening.

13. A fastening system for securing a wear component to a lip of a material handling implement, the fastening system comprising:

a clamp having opposing inwardly facing surfaces configured to engage profiles formed in respective legs of the wear component;

a wedge having opposing first and second faces, the first face having a series of teeth formed therein, and the second face being configured to engage a surface of an opening formed through the lip;

a shaft positioned in the clamp;

an externally threaded member rotatable by the shaft, and the threaded member being engaged with the wedge teeth; and a biasing device that exerts an axially biasing force against the threaded member.

14. The fastening system of claim 13, in which the threaded member is axially displaceable relative to the shaft.

15. The fastening system of claim 13, in which the threaded member is displaceable relative to the clamp along the shaft.

16. The fastening system of claim 13, in which the wedge first face is configured to slidingly engage the clamp.

17. The fastening system of claim 13, in which rotation of the shaft simultaneously compresses the biasing device and biases the wedge into the lip opening.

18. The fastening system of claim 13, in which compression of the biasing device causes the wedge to be biased into the lip opening.

* * * * *